US012440749B1

(12) United States Patent
Fazio

(10) Patent No.: US 12,440,749 B1
(45) Date of Patent: Oct. 14, 2025

(54) GAMEPLAY WITH INTERACTIVE USER-MANIPULATABLE COMPONENTS

(71) Applicant: Susan Kopp Fazio, Tequesta, FL (US)

(72) Inventor: Susan Kopp Fazio, Tequesta, FL (US)

( * ) Notice: Subject to any disclaimer, the term of this patent is extended or adjusted under 35 U.S.C. 154(b) by 0 days.

(21) Appl. No.: 18/819,559

(22) Filed: Aug. 29, 2024

(51) Int. Cl.
*A63F 3/04* (2006.01)
*A63F 3/00* (2006.01)

(52) U.S. Cl.
CPC ..... *A63F 3/0423* (2013.01); *A63F 3/00895* (2013.01); *A63F 2003/00943* (2013.01); *A63F 2003/0426* (2013.01)

(58) Field of Classification Search
CPC ..... A63F 3/0423; A63F 3/00895; A63F 2003/00943; A63F 2003/0426; A63F 1/12
See application file for complete search history.

(56) References Cited

U.S. PATENT DOCUMENTS 2,752,158 A 6/1956 James et al.
3,165,318 A * 1/1965 Lissandrello ..... A63F 3/0423 211/49.1
3,396,972 A 8/1968 Smith
4,089,084 A * 5/1978 Droz ..... E05D 11/06 403/116
4,252,323 A * 2/1981 Levinrad ..... A63F 3/0423 273/272
4,601,473 A 7/1986 Dubren et al.
4,892,319 A 1/1990 Johnson, II
5,520,394 A 5/1996 Brueckner
8,173,893 B2 * 5/2012 Huang ..... A45C 11/00 206/45.24
9,895,601 B1 * 2/2018 Wilk ..... A63F 3/0421
12,090,387 B1 * 9/2024 Ballam ..... A63F 1/10
2004/0090009 A1 5/2004 Mortimer
2006/0012122 A1 * 1/2006 Botzen ..... A63F 9/20 273/292
2008/0169608 A1 * 7/2008 Czekanski ..... A63F 3/0415 273/299
2014/0131945 A1 5/2014 McClung, III
2014/0327209 A1 * 11/2014 Mizanoski ..... A63F 3/0423 273/272
2020/0398150 A1 12/2020 Kennedy

* cited by examiner

*Primary Examiner* — Michael D Dennis
(74) *Attorney, Agent, or Firm* — Carter, DeLuca & Farrell LLP

(57) ABSTRACT

A gameplay system including user-manipulable components includes a gameplay surface having a rectangular shape, a plurality of tiles configured to be arranged on the gameplay surface, a tile bag configured to hold a first subset of the plurality of tiles, and a plurality of racks configured to hold a second subset of the plurality of tiles. Each tile of the plurality of tiles includes an indicator imprinted thereon representing an alphabetic letter. The first and second subsets of the plurality of tiles are configured to be arranged as a third subset of the plurality of tiles.

3 Claims, 6 Drawing Sheets

GAMEPLAY WITH INTERACTIVE USER-MANIPULATABLE COMPONENTS

TECHNICAL FIELD

The present disclosure relates to user gameplay, and more specifically, to a physical game with interactive, user-manipulatable components.

BACKGROUND

Games with user-manipulatable components typically include a variety of features designed to enhance interactivity, strategic depth, and replicability. With physical modular boards, players can generally add, move, or rearrange components, such as tiles, to create different layouts. These tiles may form words, patterns, or color combinations that award a player points. Various real-time factors such as time, language skills, resource management, and luck often influence gameplay outcome.

As can be appreciated, additional game components for enhancing interactivity, strategic depth, and replicability thereof must conform to certain characteristics and features in order to be suitable for gameplay. Accordingly, solutions for enhancing gameplay require a series of carefully configured components.

SUMMARY

In accordance with an aspect of the present disclosure, a gameplay system including user-manipulable components includes a gameplay surface having a rectangular shape, a plurality of tiles configured to be arranged on the gameplay surface, a tile bag configured to hold a first subset of the plurality of tiles, and a plurality of racks configured to hold a second subset of the plurality of tiles. Each tile of the plurality of tiles includes an indicator imprinted thereon representing an alphabetic letter. The first and second subsets of the plurality of tiles are configured to be arranged as a third subset of the plurality of tiles.

In an aspect of the present disclosure, the third subset of the plurality of tiles may include indicators having matching letters, matching colors, and/or sequential letters.

In another aspect of the present disclosure, a portion of the gameplay surface may define a flat plane for arranging the plurality of tiles thereon.

In yet another aspect of the present disclosure, the plurality of racks may each a shelf configured to display the second subset of the plurality of tiles thereon. The shelf may include a lower wall defining a longitudinal plane and an upper wall connected to the lower wall. The upper wall may extend in a direction perpendicular to the longitudinal plane.

In a further aspect of the present disclosure, a stand may be pivotably connected to the shelf. The stand may be configured to adjust an angle of the shelf relative to the longitudinal plane. The stand may include a recess formed in a side portion thereof, and a leg extending from a bottom portion thereof. The recess may be configured to receive a tab protruding from the shelf. The leg may be configured to stabilize a position of the stand on the gameplay surface.

In yet a further aspect of the present disclosure, the plurality of racks may each have a width of approximately 9 inches, a length of approximately 4.5 inches, and a depth of approximately 1.25 inches In another aspect of the present disclosure, the tile bag may have a width of approximately 7 inches and a length of approximately 10 inches.

In yet another aspect of the present disclosure, wherein the plurality of tiles may each have a width of approximately 1 inch, a length of approximately 1.5 inches, and a depth of approximately 0.5 inches.

In accordance with an aspect of the present disclosure, a process of gameplay including user-manipulable components includes assigning a plurality of tiles to at least two users, placing at least six tiles of the plurality of tiles on a gameplay surface by a first user to form a first row of tiles, placing a tile of the plurality of tiles on the gameplay surface by a second user to form a second row of tiles adjacent to the first row of tiles, counting a number of tiles remaining on each rack of the plurality of racks, and assigning a score to the first and second users based on the number of tiles counted. Each tile of the plurality of tiles includes an indicator imprinted thereon representing an alphabetic letter. The at least six tiles are selected from a rack of a plurality of racks.

In an aspect of the present disclosure, assigning the plurality of tiles to the at least two users may include assigning at least 20 tiles to each user at random.

In another aspect of the present disclosure, the first user of the at least two users may have a nearest upcoming birth date.

In yet another aspect of the present disclosure, placing the at least six tiles of the plurality of tiles on the gameplay surface by the first user may include removing the at least six tiles from a rack of a plurality of racks.

In a further aspect of the present disclosure, placing between three to six tiles of the plurality of tiles on the gameplay surface by the first user may include arranging the first row of tiles to include indicators having matching letters, matching colors, and/or sequential letters.

In yet a further aspect of the present disclosure, arranging the tile of the plurality of tiles on the gameplay surface may include arranging the first and second rows of tiles to include indicators having matching letters, matching colors, and/or sequential letters.

In an aspect of the present disclosure, placing the between three to six tiles of the plurality of tiles on the gameplay surface by the first user may include arranging a third row of tiles adjacent to the first row of tiles to form a first word in the English language. Each tile in the third row of tiles may include an indicator with a same color.

In another aspect of the present disclosure, arranging the tile of the plurality of tiles on the gameplay surface may form a word in the English language. The word may include three to four tiles of the plurality of tiles.

In yet another aspect of the present disclosure, the process of gameplay may further include replacing a tile having an indicator with a letter with a tile having an indicator with wildcard. The letter and the wildcard may be of a same color.

In yet another aspect of the present disclosure, the process of gameplay may further include inserting a first subset of the plurality of tiles into a tile bag, selecting a portion of the first subset of the plurality of tiles from the tile bag, assigning the plurality of racks to the at least two users, and placing the second subset of the plurality of tiles on the plurality of racks. Selecting a portion of the first subset of the plurality of tiles from the tile bag may form a second subset of the plurality of tiles.

In a further aspect of the present disclosure, placing the second subset of the plurality of tiles on the plurality of racks may include placing a tile on a shelf of each of the plurality of racks. Each shelf may include a lower wall defining a longitudinal plane and an upper wall connected to the lower wall. The upper wall may extend in a direction perpendicular to the longitudinal plane.

In yet a further aspect of the present disclosure, the process of gameplay may further include adjusting an angle of a shelf relative to the longitudinal plane using a stand pivotably connected to the shelf and moving a leg extending from a bottom portion of the stand along the gameplay surface.

In an aspect of the present disclosure, the process of gameplay may further include inserting a tab protruding from the shelf into a recess formed in a side portion of the stand.

In accordance with an aspect of the present disclosure, a gameplay system including user-manipulable components includes a plurality of tiles configured to be arranged on a gameplay surface, and a plurality of racks configured to hold a subset of the plurality of tiles. Each tile of the plurality of tiles includes an indicator imprinted thereon representing an alphabetic letter a lower wall defining a longitudinal plane. Each rack of the plurality of racks includes an upper wall, a lower wall, and a stand. The upper wall is connected to the lower wall and extends in a direction perpendicular to the longitudinal plane. The stand is pivotably connected to the upper wall and is configured to adjust an angle of the upper wall relative to the longitudinal plane. The subset of the plurality of tiles are configured to be arranged as a plurality of rows on the gameplay surface.

BRIEF DESCRIPTION OF THE DRAWINGS

Various aspects of the present disclosure are described hereinbelow with reference to the drawings, wherein.

DETAILED DESCRIPTION

Figure 1:
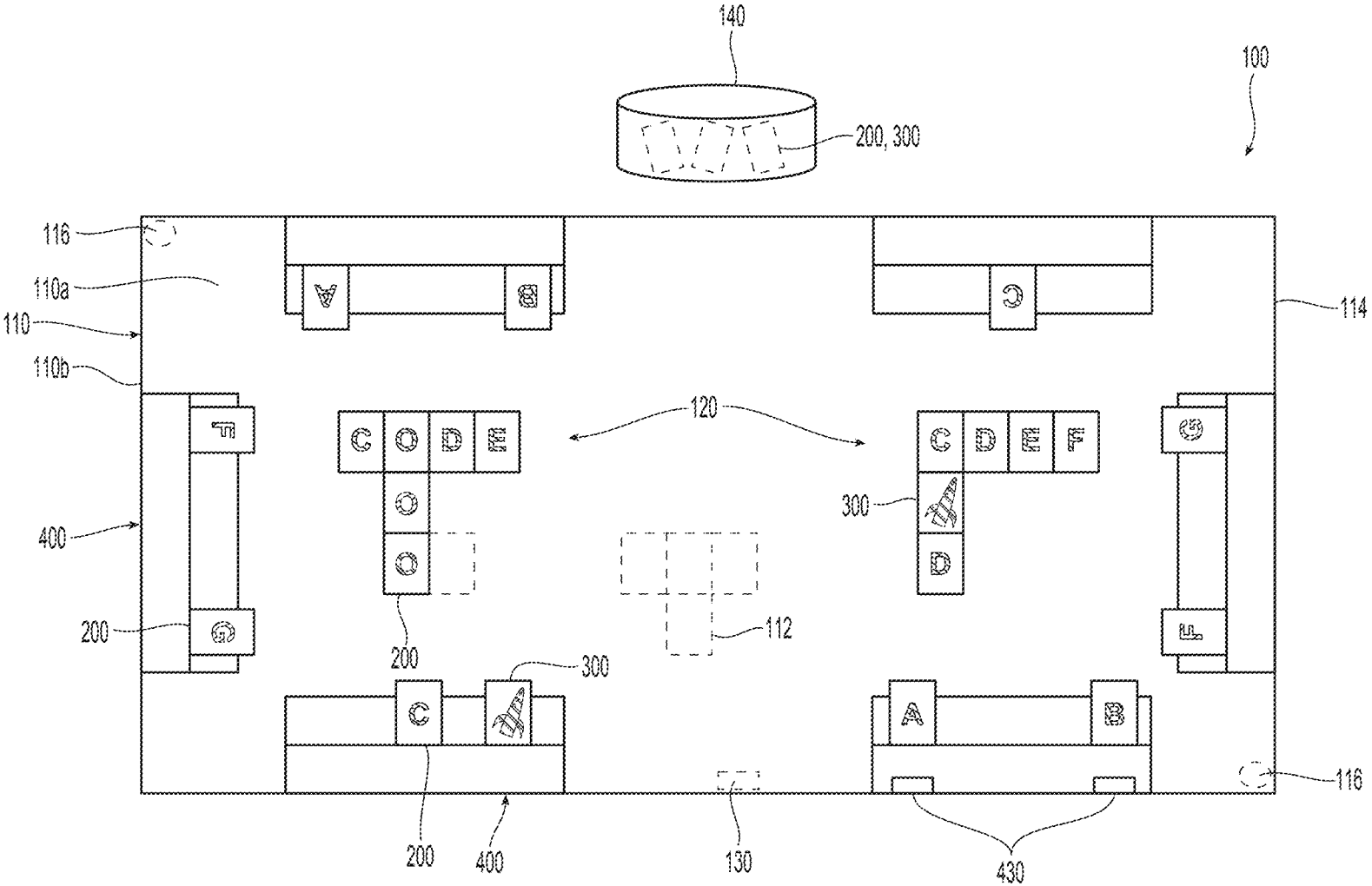
FIG. 1 is a perspective view illustrating a gameplay system using interactive user-manipulatable components in accordance with the aspects of the present disclosure.

Referring now to FIG. 1, a gameplay system 100 is provided in accordance with aspects of the present disclosure. The gameplay system 100 generally includes a tile bag 140, letter tiles 200, rocket tiles 300, and racks 400. In the gameplay system 100, various letter tiles 200 and/or rocket tiles 300 (i.e., tiles 200, 300) may be selected and/or placed onto board 110 to form various arrangements of letters and images. Tiles 200, 300 may be played to form rows 120 vertically or horizontally.

Tile bag 140 is configured to store tiles 200, 300 therein. Generally, tile bag 140 is an expandable bag formed from lightweight materials, such as fabrics (e.g., cotton, canvas, velvet, polyester) and/or synthetic materials (e.g., spandex, elastane, Lycra, nylon, faux leather). For example, tile bag 140 is typically a bag 10 inches in length by 7 inches in width, although various sizes and shaped are contemplated, e.g., to accommodate the size of tiles (discussed below) and may be formed from an opaque material to permit random selection of tiles 200, 300 by users during gameplay. Tile bag 140 may include a zipper and/or drawstrings configured to permit easy access to tiles stored therein and to seal an opening of tile bag 140 when not in use. In aspects, tile bag 140 may be a plastic container or other hard structure used as a more durable alternative to a fabric bag. Tile bag 140 may include a built-in randomizer, configured to shuffle the tile selected. For example, a tile 200, 300 may be ejected from a slot in tile bag 140 (not shown). Tile bag 140 may include a tile bag connector to attach to another component of gameplay system 100, e.g., rack 440 and/or board 110.

In aspects, gameplay system 100 may optionally include a board 110. Board 110 is configured to receive tiles 200, 300, which may be arranged along various portions of board 110 during gameplay. Generally, board 110 includes a top surface 110*a*, a bottom surface 110*b*, and an outer edge 110*c*. Board 110 is typically a 20 inch by 16 inch rectangular mat, although it will be understood that board 110 may be configured in various shapes and sizes. Board 110 may be formed from various lightweight and/or durable materials, such as vinyl, plastic, cardboard, acrylic, and/or wood. In aspects, board 110 may be configured to fold and/or roll up for convenient storage, and a sleeve and/or box (not shown) may be included with gameplay system 100 for storing the contents thereof. In aspects, portions of board 110 may be removeable, foldable, and/or interchangeable to accommodate various surface sizes.

Board 110 may include grooves 112 formed in the top surface 110*a* thereof. Grooves 112 are configured to receive letter tiles 200 and rocket tiles 300. For example, grooves 112 may match the shape of tiles 200, 300 and/or be configured to receive connectors on tiles 200, 300 (discussed below). Grooves 112 may be included on specific portions of board 110 or throughout the entire top surface 110*a*. A frame 114 may border the outer edge 110*c* of top surface 110*a*. Frame 114 may include an elevated surface configured to maintain game pieces (e.g., tiles and racks) therein. In aspects, frame 114 may include a weighted portion configured to prevent movement of board 110. A group of recesses 130 may be formed along portions of top surface 110*a*. Recesses 130 may be configured to receive connectors of racks 400 (discussed below). For example, six pairs of recesses 130 may be formed adjacent outer edge 110*c* on top surface 110*a*. In aspects, recesses 130 may be include magnets (not shown) configured to connect with magnets on tile, racks 400.

Grips 116 may be connected to bottom surface 110*b*. Grips 116 are configured to further maintain a position of board 110 on a surface during gameplay. For example, grips 116 may be beads formed from a lightweight rubber or silicone material to provide a non-slip surface. In aspects, grips 116 may include a weighted portion, e.g., weights and/or magnets, which may prevent further movement of board 110. While pictured in various corners of board 110, it will be understood that board 110 may include any number and/or arrangement of grips 116 thereon. For example, grips 116 may include patterns printed onto the entirety of bottom surface 110*b*. In aspects, board 110 may include various patterns, which may guide a user with tile placement. For example, shapes arranged in a checkered pattern on board 110 may be configured to match the shapes of tiles 200, 300. Board 110 may include a counter or other mechanism for keeping score (not shown). These additional aspects do not have to be implemented to the commercial design but should be included in a patent application for patentability purposes and defensive purposes.

In aspects, the gameplay system 100 may include a box (not shown) to hold the components required. For example, the box may be a cardboard box holding the board 110, tile bag 140, letter tiles 200, rocket tiles 300, and/or racks 400. In aspects, the box may include a quick response (QR) code, which may be scanned by a user to retrieve information about gameplay system 100. For example, a user may scan the QR code with a mobile device to pull up an inventory of gameplay components and/or the rules of the game. In aspects, the QR code may link to a website and/or a mobile app.

Figure 2:
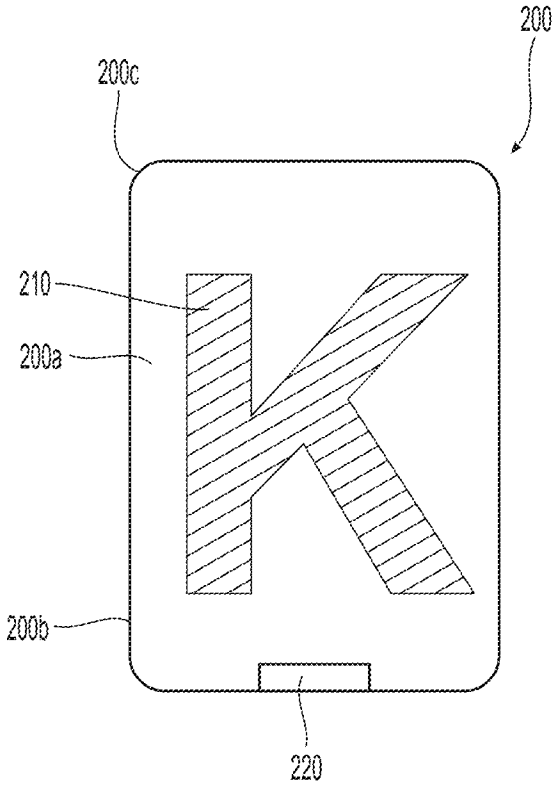
FIG. 2 is a perspective view of an exemplary tile of the gameplay system of FIG. 1, in accordance with aspects of the present disclosure.

Now referring to FIG. 2, a letter tile 200 is shown. Letter tile 200 includes a top surface 200*a*, a bottom surface 200*b*, and an outer edge 200*c*. Generally, letter tile 200 is a rectangular tile 1 inch in width by 1.5 inches in length, with a depth (e.g., thickness) of less than. 5 inches, although various sizes and/or shapes are contemplated. For example, letter tile 200 may be designed to match the shape of a corresponding letter. Letter tile 200 may be formed from various durable materials, such as ceramic, plastic, cardboard, wood, and/or metal. Letter tile 200 may include an indicator 210 representative of a letter used during gameplay. Typically, indicator 210 represents an alphabetic letter (e.g., A-Z). Indicators 210 may include one of various colors. For example, indicators 210 may be in a red, blue, yellow, green, and/or purple color, although various color arrangements are contemplated. In aspects, indicator 210 may include symbols and/or additional letters. While pictured with an indicator 210 on one side, it is contemplated that indicators 210 may be listed on both sides of letter tile 200. Letter tile 200 may include a letter tile connector 220 configured to be received within a recess 420 of rack 400 (discussed below), which is configured to maintain a position of letter tile 200 therein. In aspects, letter tile connector 220 may include a magnet (not shown) configured to connect with a magnet on rack 400.

Figure 3:
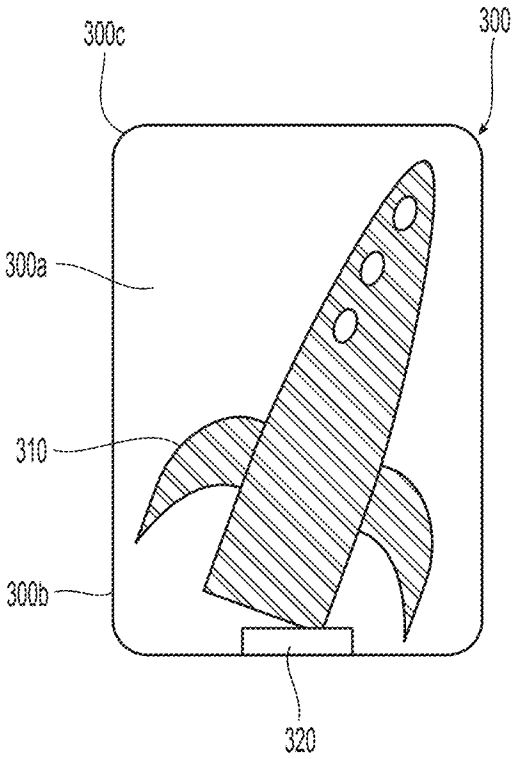
FIG. 3 is a perspective view of an exemplary tile of the gameplay system of FIG. 1, in accordance with aspects of the present disclosure.

Now referring to FIG. 3, a rocket tile 300 is shown. Rocket tile 300 includes a top surface 300*a*, a bottom surface 300*b*, and an outer edge 300*c*. Generally, rocket tile 300 is a rectangular tile 1 inch in width by 1.5 inches in length, with a thickness of less than 0.5 inches, although various sizes and/or shapes are contemplated. For example, rocket tile 200 may be designed to match the shape of a corresponding rocket. Rocket tile 300 may be formed from various durable materials, such as ceramic, plastic, cardboard, wood, and/or metal. In aspects, rocket tile 300 may include a rocket tile connector 320 configured to be received within a recess 420 of rack 400 (discussed below) which is configured to maintain a position of rocket tile 300 on rack 400. In aspects, rocket tile connector 320 may include a magnet (not shown) configured to connect with a magnet on rack 400. In aspects, connector 320 may connect rocket tiles 300 and/or letter tiles 200 together. Similarly, connector 220 may connect letter tiles 200 and/or rocket tiles 300.

Typically, rocket tile 300 includes an indicator 310 having a rocket shape. Indicators 310 may include one of various colors. For example, indicators 310 may be in a red, blue, yellow, green, purple, and/or gold color, although various color arrangements are contemplated. In aspects, indicator 310 may include symbols and/or letters. While pictured with an indicator 310 on one side, it is contemplated that indicators 310 may be listed on both sides of the rocket tile 300. Generally, indicator 310 is representative of a wildcard used during gameplay.

As used herein, a "wildcard" is defined as a rocket tile 300, where the indicator 310 may represent any letter and/or color of a user's choosing, with certain limitations. For example, a non-gold rocket tile 300 must adhere to the assigned color of indicator 310, whereas a gold rocket tile 300 can represent any color and/or letter chosen by a user. During gameplay, an indicator 310 modified by one user may be modified by a subsequent user, with certain limitations. For example, a first user may designate a red rocket tile 300 as representing a red "A" in a red and subsequently play that rocket tile 300 in a row 120, and on the next turn, a second user may play the same red rocket tile 300 as a red "C" to form an alternate row 120. The second user must first replace the red rocket tile 300 in the original row 120 with a letter tile 200 from their rack 400 having the designated indicator 210, e.g., a red "A," and the subsequent row 120 must include at least two letter tiles 200 from the player's rack 400. In aspects, gameplay system 100 may be altered to utilize rocket tiles 300 in other ways during gameplay. For example, any number of rocket tiles 300 may be used on any play, including the first row 120. In another example, rocket tiles 300 may be used to trade with tiles 200, 300 on another player's rack 400, e.g., trading a rocket tile 300 for a specific letter tile 200 of the same color.

Figure 4:
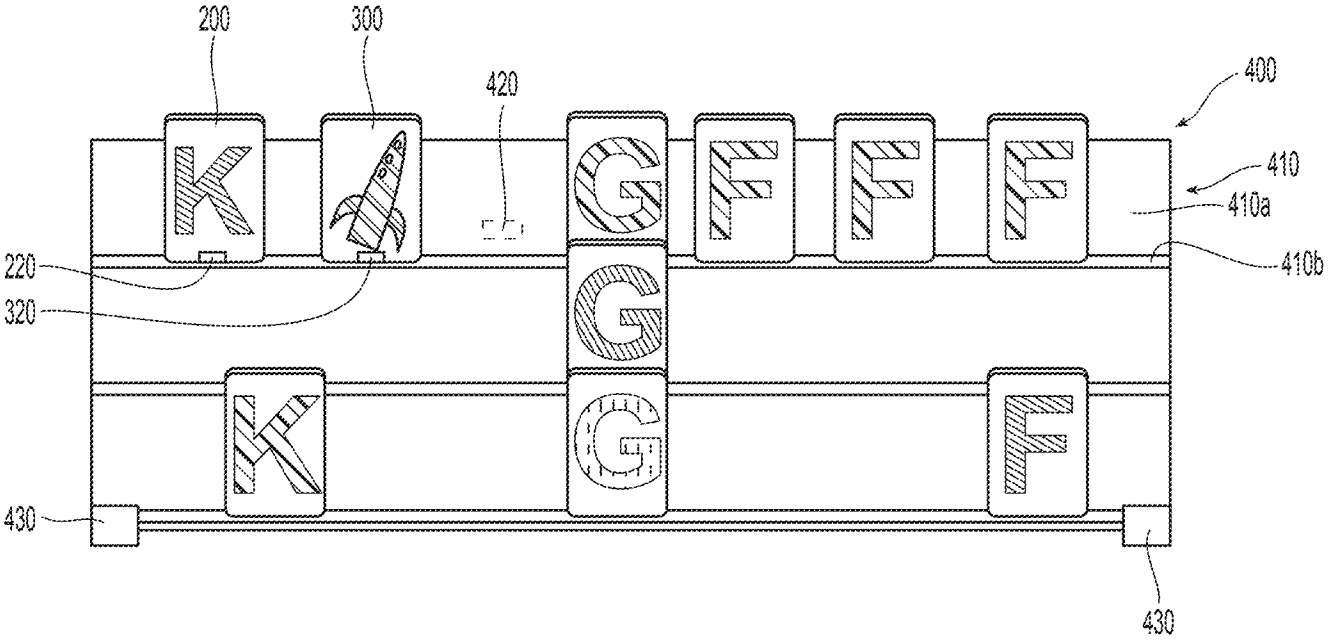
FIG. 4 is a perspective view of a rack containing components of the gameplay system of FIG. 1, in accordance with aspects of the present disclosure.
Figure 5:
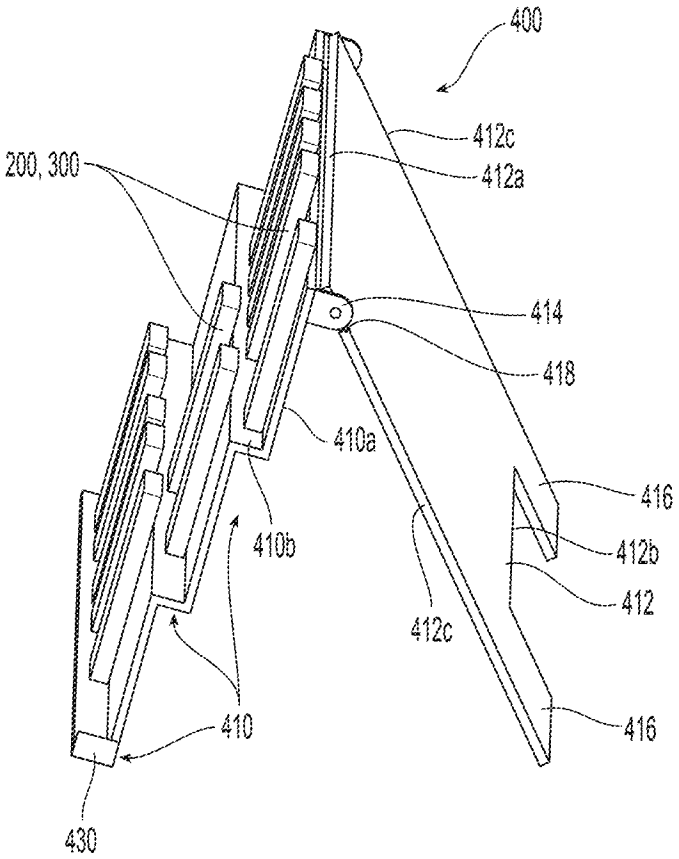
FIG. 5 is a side view of a rack containing components of the gameplay system of FIG. 1, in accordance with aspects of the present disclosure.

Now referring to FIGS. 4 and 5, a rack 400 is shown. Rack 400 includes shelves 410 and stand 412 configured to hold tiles 200, 300. Generally, rack 400 is 9 inches in width, 4.5 inches in length, and 1.25 inches in depth, although various sizes and/or shapes are contemplated. Rack 400 may be formed from various materials, such as plastic, cardboard, wood, ceramic, and/or metal. Shelves 410 each include an upper wall 410*a* and a lower wall 410*b*, which are connected to form an L-shaped structure. Lower wall 410*b* may define a longitudinal plane, where upper wall 410*a* extends in a direction perpendicular to the longitudinal angle. Upper wall 410*a* and lower wall 410*b* may be affixed using various methods, including adhesives, fasteners, taping, and/or welding. In aspects, a portion of upper wall 410*a* and/or lower wall 410*b* may include recess 420 (FIG. 4) configured to receive letter tile connector 220 and/or rocket tile connector 320. For example, shelves 410 may each include between 7-10 recesses 220 to fit an optimal number of tiles 200, 300. In aspects, rack 400 may include rack connectors 430 configured to maintain a position of rack 400 on a surface, e.g., board 110. For example, rack connectors 430 may be received within recesses 130 or board 110 (FIG. 1). In aspects, rack connectors 430 may each include a magnet (not shown) configured to connect with a magnetic surface, such as a magnet on board 110.

With further reference to FIG. 5, stand 412 includes top portion 412*a*, bottom portion 412*b*, and side portions 412*c*. Stand 412 may be pivotably connected to shelves 410. Stand 412 may be configured to pivot about an axis defined by a longitudinal plane, e.g., top portion 412*a*, which may include hinges (not pictured). Legs 416 are configured to stabilize rack 400 when placed on a surface, such as board 110. Generally, legs 416 are formed from the same material as stand 412 and extend from opposing sides of bottom portion 412*b*. While two legs 416 are shown, various configurations are contemplated (e.g. three legs 416, with an additional leg of the legs 416 located centrally for additional stabilization). One or more of shelves 410 connect with stand 412 via tab 414, enabling a depth of rack 400 to be adjustable. For example, stand 412 may be extended backwards, expanding a depth of rack 400. Generally, tabs 414 are received within stand recesses 418 formed within side portions 412*c* of stand 412. Multiple tabs 414 and/or stand recesses 418 may be included. Tabs 414 may extend from upper wall 410*a* and may include a semicircular shape, although various shapes and configurations are contemplated. In aspects, rack 400 may have an adjustable width and/or length. For example, portions of shelves 410 may be configured to slide inwards (e.g., two slidable halves, where a first half is configured to slide into a second half), allowing shelves 410 to contract or expand in width. In another example, shelves 410 may be removably attached to one another, such that removal of a shelf of shelves 410 will decrease a length of rack 400, and addition of a shelf of shelves 410 will increase a length of rack 400.

Now referring to FIG. 6, exemplary rows 120 of tiles 200, 300 of gameplay system 100 are shown. Rows 120 may be placed on a surface, e.g., board 110. During gameplay, various arrangements of rows 120 may be played to impact a player's score. Generally, four types of rows 120 are possible: sequential letters of the same color, matching letters in different colors, letters of the same color forming words, and a combination of letters and rockets. Additional arrangements and/or combinations of tiles 200, 300 with different impacts to scoring during gameplay are contemplated.

Figure 6A:
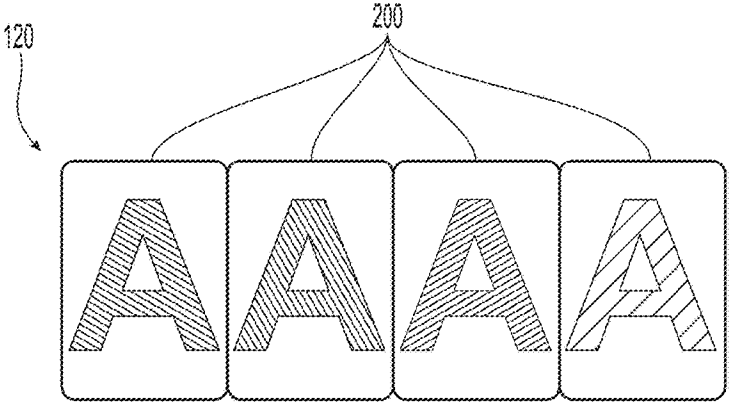
FIGS. 6A-6D illustrate exemplary arrangements of the components of the gameplay system of FIG. 1, in accordance with aspects of the present disclosure.
Figure 6B:
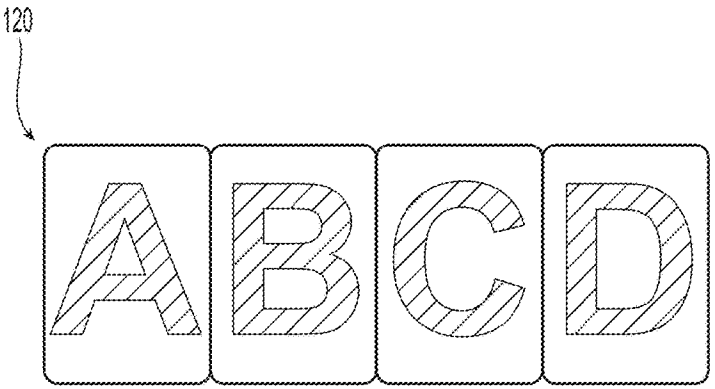
Figure 6C:
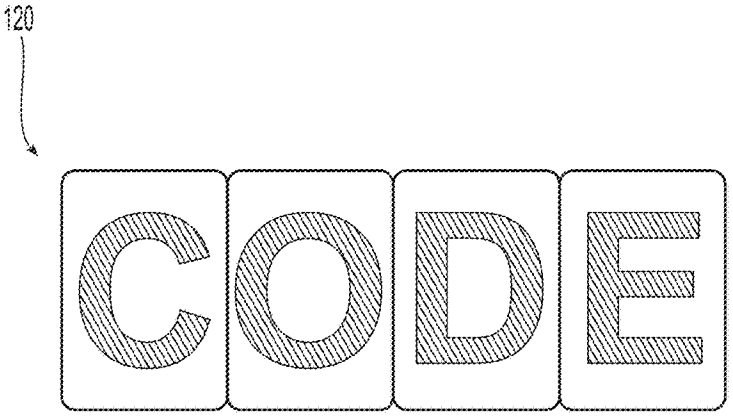

First, a row 120 may be formed from letter tiles 200 with indicators 210 having the same letter, in different colors. For example, as shown in FIG. 6A, four letter tiles 200 each containing an indicator 210 of "A" may be arranged (e.g., one red "A", one blue "A", one green "A", and one yellow "A"). Second, a row 120 may be formed from letter tiles 200 with indicators having different letters, in the same color. For example, as shown in FIG. 6B, four letter tiles 200 containing indicators 210 of "A," "B," "C," and "D" respectively may be arranged (e.g., one yellow "A", one yellow "B", one yellow "C", and one yellow "D"). The letter tiles 200 may be arranged in a sequential order (e.g., alphabetical "ABCD") and/or a non-sequential order (e.g., "BCDA"), which may impact scoring during gameplay. For example, a player may receive an advantage (e.g., a point subtraction) during gameplay for a row 120 with sequential tiles 200. Third, a row 120 may be formed from letter tiles 200 with indicators configured to form a word, in the same color. The word may be a word in the English language and/or any other acceptable language agreed upon by the users. For example, as shown in FIG. 6C, four letter tiles 200 containing indicators 210 of "C," "O," "D," and "E" respectively may be arranged to form the word "CODE" (e.g., one blue "C", one blue "O", one blue "D", and one blue "E"). Generally, the words must be between 3-4 letters in length, although different lengths are contemplated, for example, to increase or decrease a difficulty level. In aspects, a longer word may provide an advantage to a user, e.g., a decrease in point score.

Figure 6D:
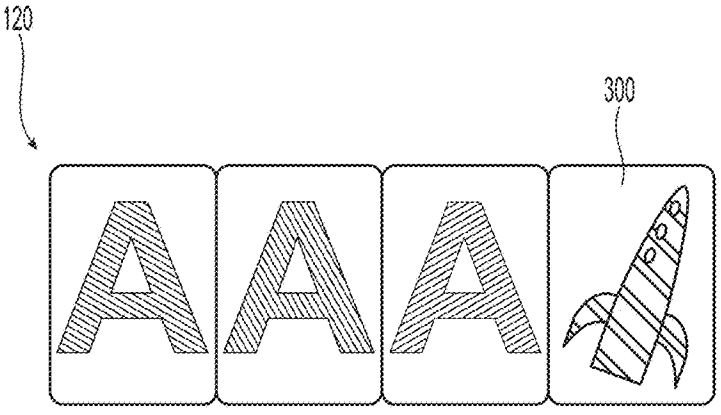

Fourth, any of the rows 120 in FIGS. 6A-6C may be achieved with the use of a rocket tile 300, which is configured to function as a wildcard. Generally, each rocket tile 300 may be used to replace a letter tile 200 required to form a particular row 120. In doing so, a user may choose the indicator 210, e.g., the letter and/or color, which the rocket tile 300 represents, dependent on the type of rocket tile 300. Multiple rocket tiles 300 may be used in a row 120. Generally, a non-gold rocket tile 300 must adhere to the color already assigned by indicator 210, e.g., a red rocket tile 300 can represent any letter, in the red color. For example, as shown in FIG. 6D, three letter tiles 200 containing indicators 210 of "A" may be arranged with a rocket tile 300 of a different color (e.g., one red "A," one blue "A," one green "A," and one yellow rocket tile, representing a yellow "A"). Alternatively, a gold rocket tile 300 may be used. The gold rocket tile 300 functions the same as a regular rocket tile 300 (e.g., red, blue, yellow, or green), with the exception of color. A gold rocket tile 300 may be used to replace a letter tile 200 of any color. For example, a gold rocket tile 300 may be used in FIG. 6D to represent a red, blue, yellow, and/or green "A."

Figure 7:
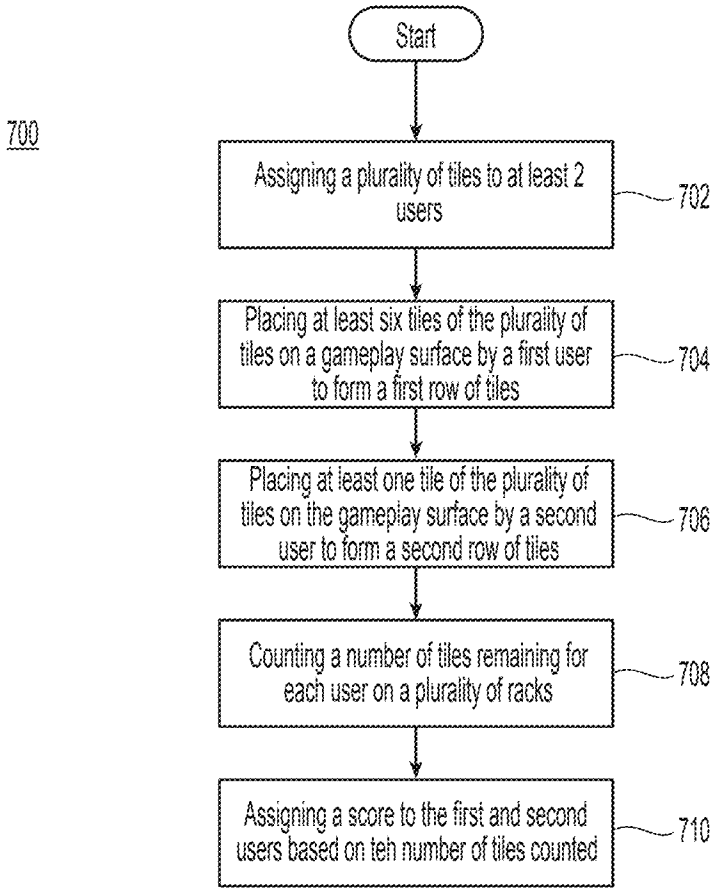
FIG. 7 is an exemplary flow diagram of a method of gameplay using interactive user-manipulatable components, in accordance with the aspects of the present disclosure.

FIG. 7 shows a method 700 for exemplary play of gameplay system 100 according to aspects of the present disclosure. Although the steps of method 700 of FIG. 7 are shown in a particular order, the steps need not all be performed in the specified order, and certain steps can be performed in another order. In various aspects, the method 700 of FIG. 7 may be performed all or in part by users with components of gameplay system 100. These and other variations are contemplated to be within the scope of the present disclosure.

Gameplay system 100 typically includes 2-6 users (e.g., "players"). The object of gameplay system 100 is to become the first user without any tiles 200, 300 remaining (e.g., no tiles left in their "hand"). To do so, a user may play tiles 200, 300 in a row 120 (FIGS. 6A-6D). Gameplay system 100 may, for example, include 187 tiles 200, 300. For example, there can be 180 letter tiles 200, in six different colors (e.g., red, blue, yellow, green, purple and/or orange, with two of each letter in each color) and seven rocket tiles 300 in seven different colors, (e.g., red, blue, yellow, green, purple, orange and/or gold, with one tile of each color). In aspects, only letter tiles 200 with indicators 220 A-O are included, and/or other subsets of the English alphabet. The letter tiles 200 and/or the rocket tiles 300 may be placed on racks 400 for storage and/or strategic arrangement for rows 120 thereon. Typically, one rack 400 is assigned to each user. However, it will be understood that various numbers of tiles 200, 300 and/or racks 400 can be used in gameplay system 100. For example, there may be between 100-300 tiles, e.g., between 100-250 letter tiles 200 and between 0-50 rocket tiles 300 may be used. When more tiles 200, 300 are used, a user may utilize more than one rack 400 to accommodate the additional components required for gameplay. As discussed above, each rack 400 may be adjustable in size. In aspects, multiple racks 400 can be connected as needed by any user.

At step 702, each user is assigned a tiles 200, 300. First, tiles 200, 300 are placed in tile bag 140 and each user is assigned a rack 400. Next, user may select about 20 tiles 200, 300 from tile bag 140 at random. In aspects, a user may shake tile bag 140 to mix up the tiles, use a tile randomizer, and/or shuffle the tiles. The 20 selected tiles 200, 300 are then placed on each user's rack 400. In aspects, one user (e.g., the "dealer") may select and/or assign tiles 200, 300 to each user. While 20 tiles are discussed, various numbers of tiles (e.g., 10-40) may be assigned. In aspects, racks 400 may also be assigned, e.g., 1-3 racks per user. During gameplay, each user will hide their rack 400 from the other users in order to keep their tiles 200, 300 confidential.

At step 704, the first user places tiles 200, 300 on a gameplay surface (e.g., board 110). Generally, the first user creates a combination of tiles 200, 300 to form a row 120, e.g., the user "plays" their tiles. Typically, the first user with the user with nearest upcoming birthday. This first user must play a predetermined number of tiles 200, 300 (e.g., six tiles)

to form an initial row 120. For example, six tiles may be placed in a row in any of the valid combinations of tiles 200, 300 (FIGS. 6A-6D). In aspects, the initial row may include between three to five tiles, and the remaining tiles 200, 300 may be played to form a subsequent row(s) 120, which may branch off of the initial row 120 or be a standalone row. The subsequent row 120 can include any valid combinations of tiles 200, 300 (FIGS. 6A-6D). For example, an initial row 120 may include letter tiles 200 forming "CODE" in all blue letters (FIG. 6C), and two additional letter tiles 200 with O's (e.g., green and yellow) may extend from the blue "O" of "CODE" in a direction perpendicular to the initial row 120 to form the subsequent row 120. In aspects, a rocket tile 300 may be used as a wildcard to form the first row 120 and/or subsequent rows 120.

If the first user cannot play at least six tiles 200, 300 meeting the above requirements, the first user will lose their turn. As a result, the first user must draw a tile 200, 300 at random from tile bag 140. Thereafter, play will continue is a counterclockwise direction (e.g., the second user is to the left of the first user), until a user is able to play at least six tiles 200, 300 meeting the above requirements. Once the initial row 120 is played, any subsequent user may play one or more tiles 200, 300 in any valid combination, as in FIGS. 6A-6D.

During gameplay, it is contemplated that users may be able to trade tiles 200, 300 as a bargaining feature of gameplay system 100. The users may trade tiles 200, 300 from each other's racks 400. For example, a first user may want to trade their rocket tile 300 on their rack 400 for a letter tile 200 containing a vowel on another user's rack 400. In aspects, trading may face limitations based on the indicator 210, 310 on the tiles 200, 300. For example, the first user may have a red rocket tile 300, and therefore can only trade for a red letter tile 200.

In step 706, a second user places tiles 200, 300 on the gameplay surface in a valid combination, as in FIGS. 6A-6D, forming a new row 120. The new row 120 is generally adjacent to and/or formed from tiles 200, 300 of the first row 120. The tiles 200, 300 may be played from the user's rack 400 and/or from the existing rows 120. Tiles 200, 300 may only be removed from an existing row 120 if at least 3 tiles 200, 300 remain that adhere to one of the valid combinations. Similarly, any new row 120 must include at least 3 tiles 200, 300. If a user cannot play any of their tiles 200, 300 they will lose their turn and must draw a tile 200, 300 at random from tile bag 140. Gameplay will continue until a user has no remaining tiles 200, 300 on their rack 400.

At step 708, when a user has no remaining tiles 200, 300 on their rack 400, a number of tiles remaining on other racks 400 are counted. At this point, typically the game has officially ended. However, gameplay may continue until only one user with tiles 200, 300 left remains. For example, with 6 users, play may continue until only one user has tiles on their rack 400 remaining.

At step 710, a score is assigned to each user. Generally, a user's score is calculated based on how many tiles 200, 300 remain on their rack, where each tile represents one point. Thus, a player with less tiles 200, 300 will place higher than a user with more tiles 200, 300 remaining. In aspects, different types of tiles 200, 300 will have different point values assigned. For example, a letter tile 200 may equal two to three points, a non-gold rocket tile 300 may equal two points, and a golden rocket tile may equal two or one points. In aspects, different tile and/or word arrangements thereof may further decrease a user's score. For example, a 4-letter word may decrease a user's score (i.e., increase their chances of winning) by two points, where each letter placed equals −0.5. In aspects, the point system may be reversed, and the highest score will win, based on a variety of criteria similar to those above. Once a score is assigned to each user, the place of each user can be determined (e.g., first second, third, fourth, fifth, sixth place.)

In aspects, gameplay may require rows 120 that do not form words. For example, only rows forming the arrangements of the same letter or sequential letters in the same color (FIGS. 6A and 6B) are acceptable. In another example, only sequential rows 120 in alphabetical order are allowed. Alternatively, in another example, any order of tiles 200, 300 may form a row when having the same color. In aspects, certain tiles 200, 300 may be prohibited. For example, all rocket tiles 300 may be prohibited from play. Other rule modifications, additions, and subtractions are contemplated and within the scope of this disclosure.

Certain aspects of the present disclosure may include some, all, or none of the above advantages and/or one or more other advantages readily apparent to those skilled in the art from the figures, descriptions, and claims included herein. Moreover, while specific advantages have been enumerated above, the various aspects of the present disclosure may include all, some, or none of the enumerated advantages and/or other advantages not specifically enumerated above.

The aspects disclosed herein are examples of the disclosure and may be embodied in various forms. For instance, although certain aspects herein are described as separate aspects, each of the aspects herein may be combined with one or more of the other aspects herein. Specific structural and functional details disclosed herein are not to be interpreted as limiting, but as a basis for the claims and as a representative basis for teaching one skilled in the art to variously employ the present disclosure in virtually any appropriately detailed structure. Like reference numerals may refer to similar or identical elements throughout the description of the figures.

The phrases "in an embodiment," "in aspects," "in various aspects," "in some aspects," or "in other aspects" may each refer to one or more of the same or different example Aspects provided in the present disclosure. A phrase in the form "A or B" means "(A), (B), or (A and B)." A phrase in the form "at least one of A, B, or C" means "(A); (B); (C); (A and B); (A and C); (B and C); or (A, B, and C)."

It should be understood that the foregoing description is only illustrative of the present disclosure. Various alternatives and modifications can be devised by those skilled in the art without departing from the disclosure. Accordingly, the present disclosure is intended to embrace all such alternatives, modifications, and variances. The aspects described with reference to the attached figures are presented only to demonstrate certain examples of the disclosure. Other elements, steps, methods, and techniques that are insubstantially different from those described above and/or in the appended claims are also intended to be within the scope of the disclosure.

What is claimed is:

1. A process of gameplay including user-manipulable components, the process comprising:

providing a gameplay system, including:

a gameplay surface defining a flat plane;

a plurality of tiles configured to be arranged on the gameplay surface, wherein each tile of the plurality of tiles includes an indicator imprinted thereon and a first magnet, wherein a portion of indicators represent alphabetic letters;

a tile bag configured to hold a first subset of the plurality of tiles; and a plurality of racks configured to hold a second subset of the plurality of tiles, each rack of the plurality of racks including:

at least one shelf configured to support the second subset of the plurality of tiles thereon, the at least one shelf having a lower wall connected to an upper wall, the lower wall defining a horizontal plane and the upper wall defining a vertical plane extending in a direction perpendicular to the horizontal plane;

a pair of tabs projecting from diametrically opposing sides of the upper wall of an uppermost shelf of the at least one shelf in a direction parallel to the horizontal plane;

a second magnet configured to couple to the first magnet to maintain a position of each tile of the plurality of tiles on the at least one shelf; and a stand pivotably connected to the at least one shelf and configured to selectively adjust an angle of the at least one shelf relative to the flat plane of the gameplay surface, the stand including:

a pair of recesses each formed in an outermost section of an upper portion of the stand, the pair of recesses dimensioned to receive the pair of tabs to maintain the angle of the at least one shelf relative to the flat plane; and a pair of legs extending from an outermost section of a bottom portion of the stand, the pair of legs configured to stabilize a position of the stand on the gameplay surface, wherein the stand is formed as a solid, continuous panel extending from the bottom portion to the upper portion thereof;

inserting the first subset of the plurality of tiles into the tile bag;

selecting a portion of the first subset of the plurality of tiles from the tile bag to form the second subset of the plurality of tiles;

assigning the second subset of the plurality of tiles to at least two users;

placing the second subset of the plurality of tiles on the at least one shelf of each of the plurality of racks;

arranging, by a first user, between three to six tiles of the plurality of tiles on the gameplay surface to form a first row of tiles, wherein the first row of tiles are arranged to include indicators having at least one of matching letters, matching colors, or sequential letters;

arranging, by a second user, at least one tile of the plurality of tiles on the gameplay surface to form a second row of tiles adjacent to the first row of tiles, the first and second rows of tiles arranged to include indicators having at least one of matching letters, matching colors, or sequential letters;

replacing, by the first user or the second user, a tile having an indicator representing a letter with a tile having an indicator representing a wildcard, wherein the colors of the letter and the wildcard are matching;

arranging at least one tile of the plurality of tiles on the gameplay surface by the first user or the second user to form a third row of tiles adjacent to the first or second row of tiles to form a word in the English language, each tile in the third row of tiles including an indicator with a matching color;

counting, for each user of the at least two users, a number of the plurality of tiles remaining on each of the plurality of racks; and assigning a score to each user of the at least two users based on the number of tiles counted.

2. The process of gameplay of claim 1, wherein assigning the second subset of the plurality of tiles to the at least two users includes assigning at least twenty tiles to each user at random.

3. The process of gameplay of claim 1, wherein the first user has a nearest upcoming birth date.

* * * * *